US005390476A

United States Patent [19]

Morantz

[11] Patent Number: 5,390,476

[45] Date of Patent: Feb. 21, 1995

[54] APPARATUS FOR WRAPPING ARTICLES IN PLASTIC FILM

[75] Inventor: Jack I. Morantz, Westmount, Canada

[73] Assignee: Newtec International, France

[21] Appl. No.: 83,518

[22] Filed: Jun. 30, 1993

[51] Int. Cl.[6] ..... B65B 53/00; B65B 11/02

[52] U.S. Cl. ..... 53/556; 53/588

[58] Field of Search ..... 53/210, 556, 588

[56] References Cited

U.S. PATENT DOCUMENTS

| | | | |
|---|---|---|---|
| 2,797,634 | 7/1957 | Rueckert . | |
| 3,252,408 | 5/1966 | Wrinkler . | |
| 3,583,310 | 8/1971 | Blough . | |
| 4,369,614 | 1/1983 | Tetzner | 53/588 X |
| 4,587,796 | 5/1986 | Haloila | 53/588 |
| 4,619,193 | 10/1986 | Crew | 53/588 X |
| 4,756,143 | 7/1988 | Lancaster | 53/588 X |
| 4,829,753 | 5/1989 | Bricmont | 53/588 |
| 4,936,080 | 6/1990 | Haloila . | |
| 4,939,989 | 7/1990 | Zacharias | 53/588 X |
| 5,161,349 | 11/1992 | Lancaster et al. . | |

OTHER PUBLICATIONS

Three page brochure entitled "Maxim oy Horizon Pall-Wrap Sep. 1992".

*Primary Examiner*—Linda B. Johnson

*Attorney, Agent, or Firm*—Vickers Daniels & Young

[57] ABSTRACT

Apparatus for wrapping articles in film material includes a stationary frame supporting a vertically reciprocable frame which in turn supports a rotatable ring member carrying a film carriage assembly by which film is wrapped around an article during rotation of the ring member. The ring is in the form of an outwardly open channel and is supported for rotation relative to the reciprocable frame by wheels on the latter which underlie the upper flange of the channel. The web of the channel is captured between pairs of wheels mounted on the reciprocable frame, and a wheel of one of the pairs is driven to rotate the ring relative to the reciprocable frame. The reciprocable frame is elevated and lowered relative to the stationary frame by a chain drive arrangement, and the stationary and reciprocable frames have interengaging guide components at two diametrically opposed locations.

35 Claims, 5 Drawing Sheets

APPARATUS FOR WRAPPING ARTICLES IN PLASTIC FILM

BACKGROUND OF THE INVENTION

The present invention relates in general to the art of apparatus for packaging articles in plastic film material and, more particularly, to improvements in such apparatus of the character wherein the plastic film material is wrapped around a stationary article.

Apparatus of the character to which the improvements according to the present invention find particular utility is disclosed in U.S. Pat. No. 4,587,796 to Haloila, the disclosure of which is hereby incorporated by reference herein for background purposes. This apparatus includes a stationary frame for receiving an article to be wrapped, a vertically reciprocable frame supported on the stationary frame, and a ring member supported on the reciprocating frame for displacement therewith and for rotation relative thereto about a vertical ring axis. A film carriage assembly is mounted on the ring member for displacement therewith, and a film clamping and sealing assembly is mounted on the reciprocable frame for displacement therewith, and these assemblies cooperate during rotation of the ring member to wrap the plastic film about the article and to heat seal the cut-off end thereof against the underlying wrap.

Heretofore, the support and drive arrangements for the ring member have necessitated that the latter be accurately formed or machined to a substantially perfect circular configuration, whereby construction of the ring member was extremely time consuming and expensive. Because of the required accuracy with respect to the roundness of the ring member, the latter was fabricated from two matching pieces suitably secured together and machined to obtain the necessary accuracy in profile. Further, if the ring member is driven by a belt and pulley arrangement as disclosed in the aforementioned Haloila patent, the time and expense is increased by providing the ring member with a belt groove and by providing a specially sized belt for the drive arrangement.

Further in connection with such wrapping apparatus heretofore available, guidance of the elevating and lowering of the reciprocable frame relative to the stationary frame assembly included complex guide roller arrangements between the stationary and reciprocable frame components. For example, the stationary frame was provided with vertical guide members having guide surfaces at 90° to one another and the reciprocable frame was provided with guide rollers having roller axes at 90° relative to one another for the rollers to engage the guide surfaces. The stationary and reciprocable frames are of rectangular configuration, and such guidance arrangements were provided at all four corners therebetween and have to be carefully adjusted relative thereto, thus adding to the time and expense of constructing the apparatus. Vertical guidance has also been provided by interengaging rollers and tracks at the four corners between the stationary and reciprocable frame units and in which the axes of the roller components at diametrically opposite corners of the apparatus are transverse to a line therebetween. Such guidance assemblies include specifically profiled rollers and tracks as well as adjustable roller units. Accordingly, these guidance arrangements are also undesirably expensive.

Another disadvantage in conjunction with wrapping apparatus of the foregoing character heretofore provided resides in the drive arrangement for elevating and lowering the reciprocable frame relative to the stationary frame structure. In this respect, the reciprocating drive was achieved by vertically extending chain drive units adjacent the four corners between the two frames. The chain units must be drive in unison to achieve elevation and lowering of the reciprocable frame without interference with the stationary frame and, more importantly, to achieve and maintain a horizontal disposition of the ring member and vertical disposition of the ring axis relative to the article being wrapped. Such unison in operation is extremely difficult to obtain and maintain due to the free play between chain and sprocket wheels which is compounded by a long endless chain belt in each of the four corners and the cross belts necessary for the four chains to be driven simultaneously. Moreover, the provision of five or six endless chain belts requires a considerable amount of link chain which adds to the cost of construction of the apparatus. Other arrangements have included link chains adjacent the four corners of the stationary and reciprocable frame units with one end of the chain attached to the reciprocable frame and the other end attached to a counterweight. The link chains extend around sprocket wheels on the stationary frame, and the chains on opposite sides of the apparatus are driven in unison by an endless chain between the shafts supporting the sprocket wheels. Such an arrangement is also undesirably expensive with respect both to the provision of counterweights and appropriate support and guidance for the movement thereof during raising and lowering of the reciprocable frame.

SUMMARY OF THE INVENTION

In accordance with the present invention, improvements are provided in film wrapping apparatus of the foregoing character which materially reduce the time and cost of construction of the apparatus while at the same time maintaining a desired structural integrity and efficiency in operation with respect to the wrapping of articles in plastic film material. More particularly in this respect, wrapping apparatus in accordance with the present invention has an improved support and drive arrangement for the ring member, whereby the latter does not have to be perfectly round and therefore can be fabricated with considerable cost savings. Regardless of whether advantage is taken with respect to such cost saving, a reduction in cost is still realized as a result of the structural simplicity of the support and drive arrangement. More particularly with regard to this aspect of the invention, the ring member is an outwardly open channel having a vertical web and a horizontally outwardly extending upper flange, and the ring member is supported in suspension on a plurality of wheels mounted on the reciprocable frame to underlie the upper flange of the ring member. The web of the ring member is radially engaged between wheels mounted on the reciprocable frame, and one such wheel is motor driven to rotate the ring member during operation of the apparatus. The wheels supporting the ring member in suspension are angularly spaced apart relative to the axis thereof and are in a number and are positioned radially of the upper flange of the ring member such that the latter, even if out-of-round and thus not horizontally fixed during rotation thereof, will nonetheless be supported during such rotation.

In accordance with another aspect of the invention, an improved, structurally simple guide arrangement is provided between the stationary and vertically reciprocable frame assemblies which avoids the use of special roller arrangements between the frame assemblies and special roller and guide track profiles, thus to reduce the costs of the component parts of the guidance arrangements as well as the time required to install and adjust the same while, at the same time, retaining the desired guidance function and structural integrity of the guide components. More particularly in accordance with this feature, the guide components include a guide channel on the stationary frame assembly and guide blocks of polymeric material attached to the reciprocable frame assembly and received in the guide channels. The desired guidance function can be achieved with just two such guide arrangements provided in diametrically opposed corners between the stationary and reciprocable frame assemblies.

In accordance with yet a further aspect of the invention, an improved drive chain arrangement is provided for supporting and displacing the vertically reciprocable frame unit relative to the stationary frame assembly. The arrangement provides improved stability with respect to supporting and maintaining the reciprocable frame in a horizontal disposition during displacement thereof relative to the stationary frame. This is achieved by providing a plurality of link chains each having opposite ends structurally inter-related with two different frame members of the stationary frame so as to support the reciprocable frame in suspension relative to the stationary frame adjacent the four corners therebetween. The arrangement minimizes free play between the link chains and sprocket wheels therefor and optimizes operation of the chain drive components in unison to achieve the desired stability and disposition of the reciprocable frame during elevating and lowering thereof relative to the stationary frame. Further, the chain drive arrangement is structurally simple and easy to install, optimizes the amount of link chain required and, thus, enables achieving an improved drive arrangement while reducing the cost thereof.

It is accordingly an outstanding object of the present invention to provide cost saving and operational improvements in connection with the structure and operation of film wrapping apparatus of the character comprising a stationary frame which supports a vertically reciprocable frame carrying a ring member rotatable about a ring axis for paying film material supported thereon about an article during rotation of the ring member.

Another object is the provision of apparatus of the foregoing character with an improved support and drive arrangement for the ring member.

Yet another object is the provision of apparatus of the foregoing character with a support and drive arrangement for the ring member which provides for the latter to be supported and rotated even if out-of-round in peripheral contour.

A further object is the provision of apparatus of the foregoing character with an improved guidance arrangement between the stationary and reciprocable frame assemblies thereof for guiding relative displacement therebetween.

Still a further object is the provision of apparatus of the foregoing character with interengaging guide components on the stationary and reciprocable frame assemblies structured and cooperatively interengagable in a manner whereby desired guidance is achieved with such interengaging components in just two diametrically opposed corners between the frame units.

Another object is the provision of apparatus of the foregoing character with an improved support and drive arrangement for supporting and displacing the reciprocable frame assembly relative to the stationary frame assembly.

Still a further object is the provision of apparatus of the foregoing character with an improved drive chain arrangement by which the reciprocable frame assembly is supported in suspension adjacent the four corners between the stationary and reciprocable frame assemblies and by which the reciprocable frame is displaced relative to the stationary frame during operation of the apparatus.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 1:
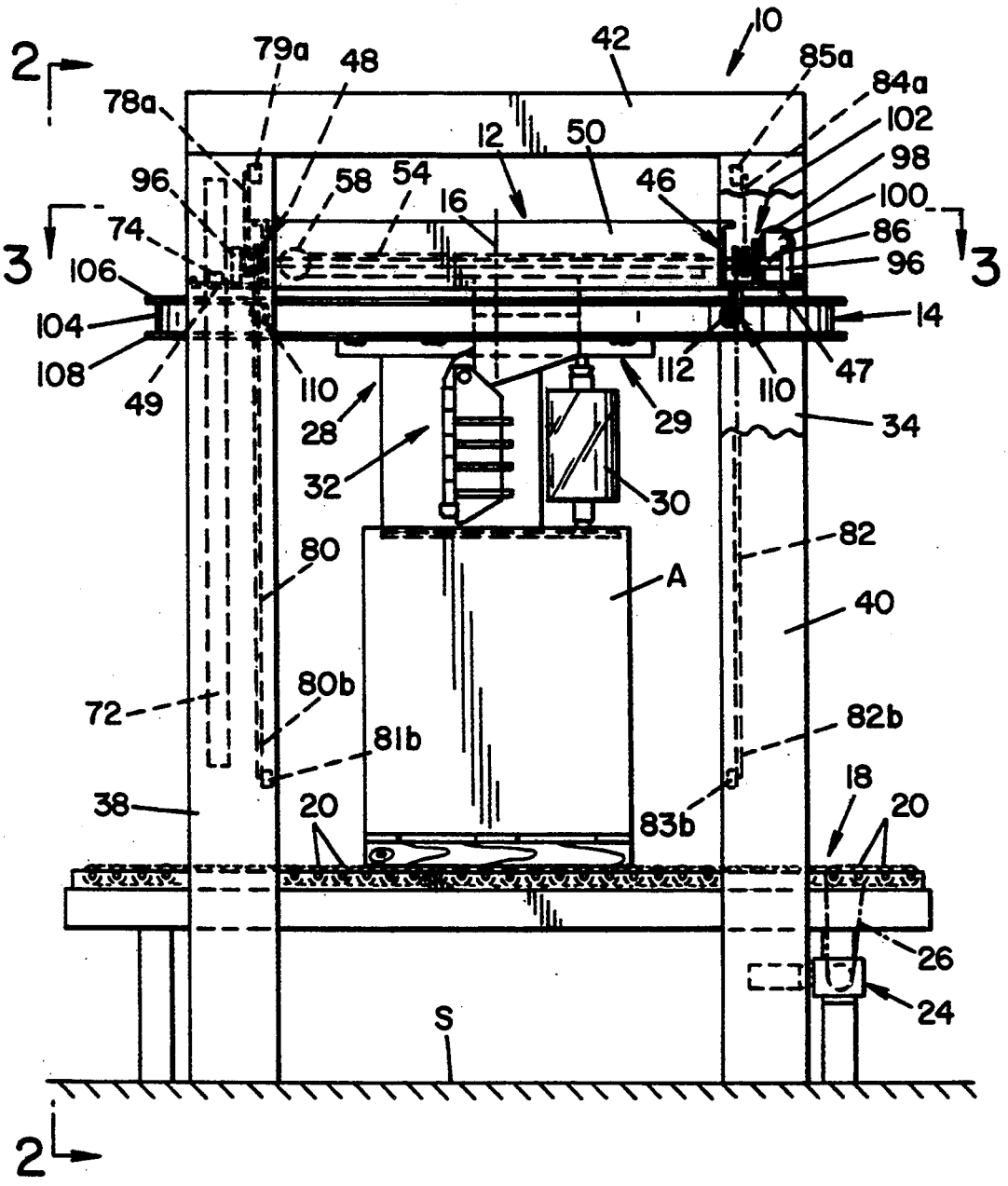
FIG. 1 is a side elevation view, partially in section, of wrapping apparatus in accordance with the present invention.

Referring now in greater detail to the drawings wherein the showings are for the purpose of illustrating preferred embodiments of the invention only and not for the purpose of limiting the invention, wrapping apparatus in accordance with the present invention includes a stationary frame assembly 10, a frame assembly 12 supported on frame assembly 10 as described hereinafter for vertical displacement relative thereto, and a ring member 14 supported as described hereinafter on frame assembly 12 for vertical displacement therewith and for rotation relative thereto about a vertical ring axis 16. Stationary frame assembly 10 is supported on an underlying surface S and spans a conveyor 18 by which an article A to be wrapped is moved into position within the apparatus. Conveyor 18 may, for example, be a roller conveyor in which the rolls 20 have sprocket wheels at one end drivingly interengaged by chains 22 therebetween and one of which rolls is driven by a suitable motor and gear reducer assembly 24 and drive chain 26. A film carriage assembly 28 is mounted on ring member 14 by means of a mounting bracket 29. Carriage assembly 28 is displaceable with ring member 14 and includes a roll 30 of plastic film material from which film material is payed out during operation of the apparatus to wrap article A. As described more fully hereinafter, a film clamping and sealing assembly 32 is mounted on vertically reciprocable frame assembly 12 for displacement therewith and relative thereto. As is well known, assembly 32 is operable during wrapping to engage the film material during rotation of ring member 14 to cause the film material to be payed out from roll 30 as the latter rotates about article A with ring member 14 and to sever and seal the film material after the wrapping operation is completed.

Figure 2:
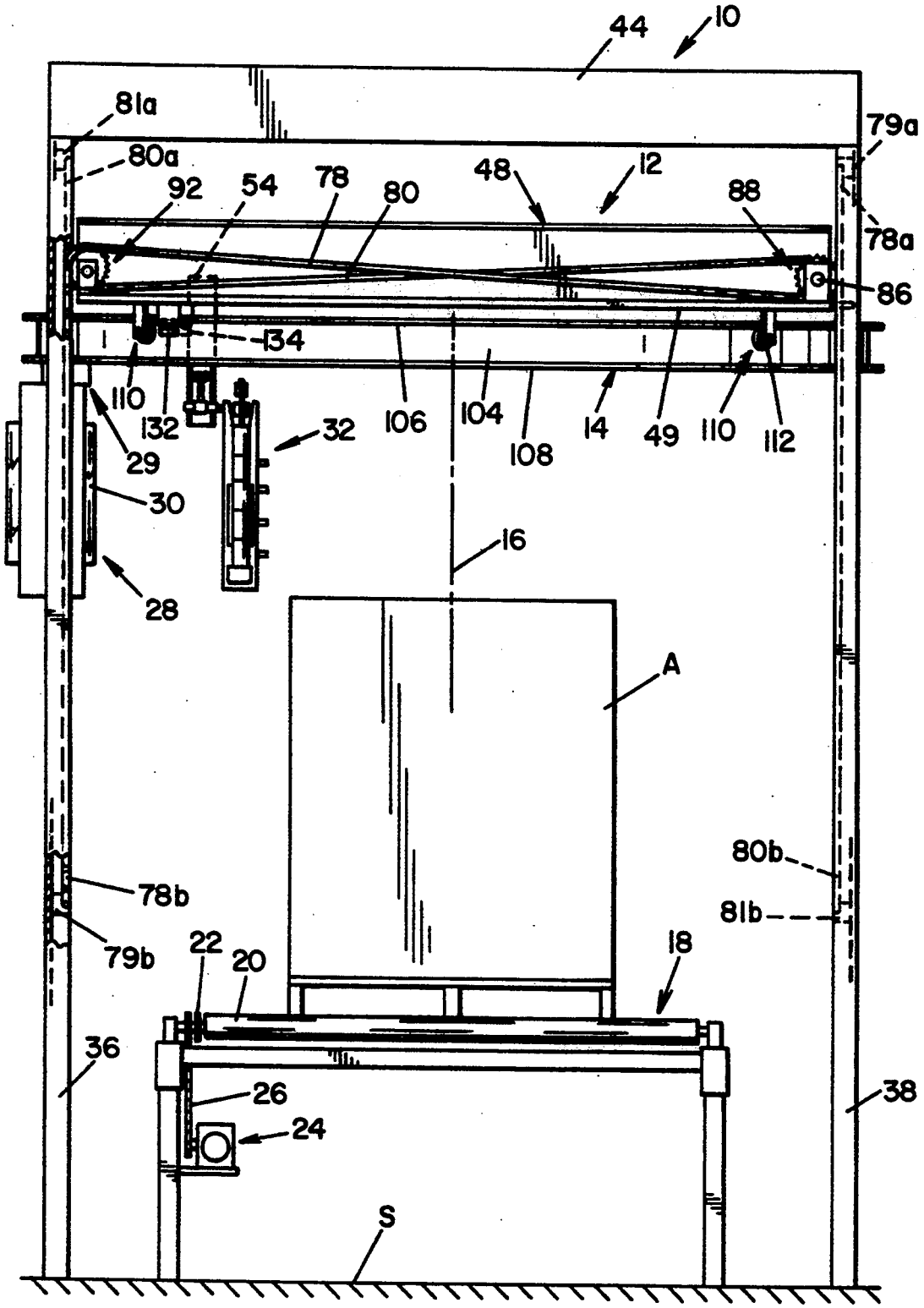
FIG. 2 is an end elevation view, partially in section, of the apparatus taken along line 2—2 in FIG. 1
Figure 3:
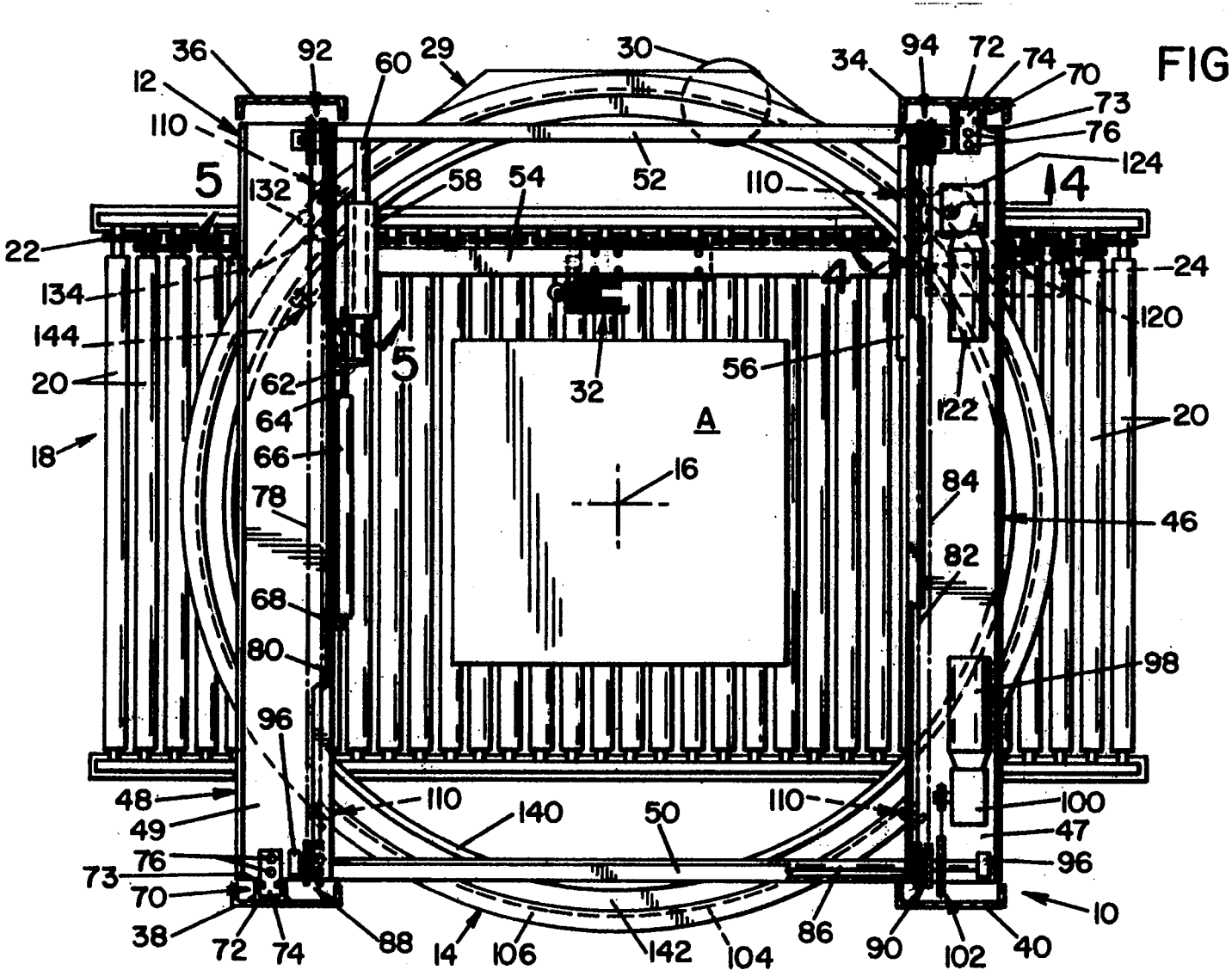
FIG. 3 is a plan view, in section, of the apparatus taken along line 3—3 in FIG. 1.

As best seen in FIGS. 1–3 of the drawing, stationary frame assembly 10 is comprised of four upright corner members 34, 36, 38 and 40 each of which is a steel channel opening inwardly relative to the opposite sides of conveyor 18. As shown in FIG. 1, frame assembly 10 further includes a cross member 42 between corner members 38 and 40 and, while not shown, it will be appreciated that a corresponding cross member is provided between corner members 34 and 36. As seen in FIG. 2, frame assembly 10 includes a cross member 44 between corner members 36 and 38 and again, while not shown, it will be appreciated that a corresponding cross member is provided between corner members 34 and 40. The corner members and cross members are suitably interconnected, such as by welding.

Reciprocable frame assembly 12 is comprised of end members 46 and 48 which include horizontal plate portions 47 and 49, respectively. Members 46 and 48 respectively extend between corner members 34 and 40 and between corner members 36 and 38 of stationary frame assembly 10. Frame 12 further includes side members 50 and 52 respectively interconnecting the ends of end members 46 and 48 adjacent corner members 38 and 40 and adjacent corner members 34 and 36 of stationary frame 10. Frame members 46, 48, 50 and 52 are suitably interconnected such as by welding. As mentioned hereinabove, film clamping and sealing assembly 32 is mounted on reciprocable frame assembly 10 for displacement therewith and relative thereto. More particularly in this respect, as best seen in FIG. 3, the film clamping and sealing assembly is secured to a beam 54 having one end pivotally supported by a rail member 56 which is secured to frame member 46. The other end of beam 54 is secured to a guide sleeve 58 slidably receiving a shaft 60 having its outer end secured to frame member 52 and its inner end secured to frame member 48 by a bracket 62. Sleeve 58 is adapted to be displaced relative to shaft 60 so as to pivot beam 54 relative to rail 56 and, for this purpose, sleeve 58 is attached to the outer end of the piston rod 64 of a pneumatic piston and cylinder assembly including a cylinder 66 secured to frame member 48 by bracket 68. As will be appreciated from FIG. 3, such displacement of beam 54 moves film clamping and sealing assembly 32 laterally inwardly and outwardly relative to article A.

In accordance with one aspect of the present invention, reciprocation of frame assembly 12 relative to stationary frame assembly 10 is guided by interengaging guidance arrangements 70 between the two frame assemblies. More particularly in this respect, each of the corner members 34 and 38 of frame assembly 10 which are diametrically opposite relative to axis 16 is provided with a vertically extending generally C-shaped guide channel 72 suitably secured thereto such as by welding. Channels 72 open inwardly of the corresponding corner member and have laterally inwardly extending flanges 73. The end of plate portion 47 of frame member 46 of frame assembly 12 adjacent corner member 34 is provided with a guide block 74 adjustably secured thereto such as by bolts 76. The outer end of guide block 74 is received in guide channel 72 for sliding interengagement therewith and has laterally inwardly opening recesses, not designated numerically, which receive guide channel flanges 73. Similarly, a guide block 74 is mounted on the end of plate portion 49 of frame member 48 of frame assembly 12 adjacent corner member 38 of frame assembly 10 and is slidingly interengaged with guide channel 72 on frame member 38. Guide blocks 74 are of a suitable polymeric material such as nylon and, as will be appreciated from FIG. 3, interengage with the corresponding guide channel 72 so as to preclude lateral, longitudinal and rotative displacement of frame assembly 12 relative to stationary frame assembly 10. Thus, the desired guidance is achieved with guidance assemblies in just two diametrically opposite corners of the two frame assemblies.

Figure 6:
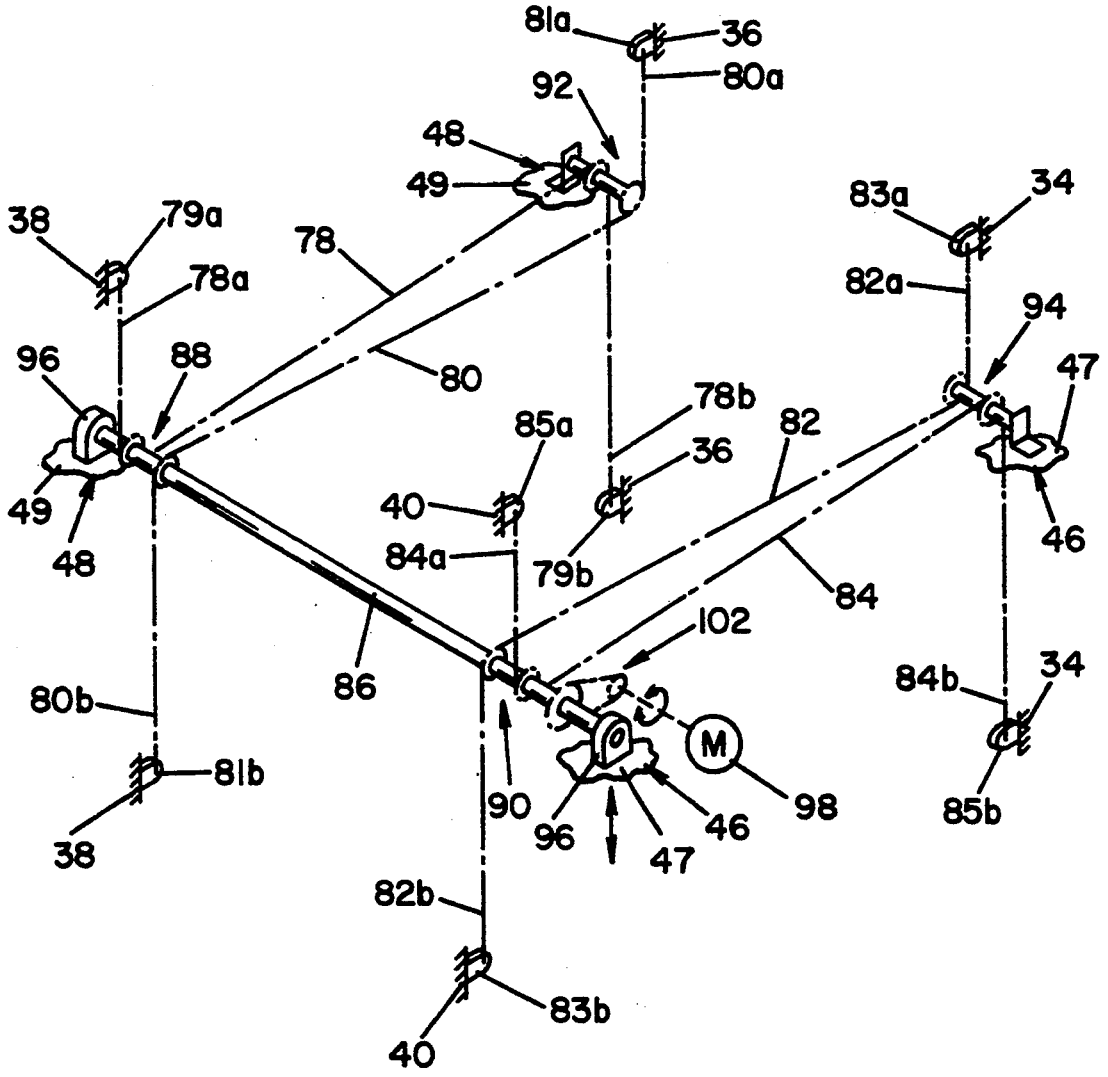
FIG. 6 is a schematic illustration of the link chain support and drive arrangement between the stationary and vertically reciprocable frame assemblies of the apparatus.

In accordance with another aspect of the present invention, reciprocable frame assembly 12 is adapted to be supported on stationary frame assembly 10 for vertical displacement relative thereto by a link chain support and drive arrangement schematically illustrated in FIG. 6. Referring in particular to FIGS. 1–3 and 6, the drive arrangement includes four link chains 78, 80, 82, and 84, a common drive shaft 86 for the chains including driven sprocket wheel unit 88 for chains 78 and 80 and driven sprocket wheel unit 90 for chains 82 and 84, an idler sprocket wheel unit 92 for chains 78 and 80 and an idler sprocket wheel unit 94 for chains 82 and 84. Drive shaft 86 extends between frame members 46 and 48 of frame assembly 12 and is mounted on the plate portions 47 and 49 thereof for rotation by means of pillow blocks 96 at the opposite ends of the shaft. Shaft 86 is adapted to be driven by an electric motor 98 through a gear reduction unit 100, both of which are mounted on plate portion 47 of frame member 46, and a chain drive arrangement 102 between the reducer and shaft 86. Idler sprocket wheel units 92 and 94 are respectively supported on the opposite ends of plate portions 49 and 47 of frame members 48 and 46 from the ends supporting shaft 86.

The opposite ends of each of the chains 78, 80, 82 and 84 are rigidly connected to the corner members of stationary frame assembly 10 in vertically and horizontally spaced apart relationship and, when trained about the corresponding sprocket wheels, the chains of each pair have intermediate portions extending along paths which cross one another between the corresponding driven and idler sprocket wheel units. More particularly in this respect, as will be appreciated from FIGS. 1, 2 and 6, chain 78 has one end **78*a* rigidly secured to corner frame member 38 adjacent the upper end thereof by a suitable anchor 79*a*, and the chain extends downwardly therefrom beneath the corresponding sprocket wheel of driven sprocket wheel unit 88 across to and over the corresponding sprocket wheel of idler sprocket wheel unit 92 and thence downwardly and terminates in a second end 78*b* rigidly secured by anchor 79*b* to corner frame member 36 well below the vertical level of end 78*a*. Similarly, chain 80 has a first end 80*a* rigidly secured to corner member 36 of frame assembly 10 by anchor 81*a*, and the chain extends downwardly and under the corresponding sprocket wheel of idler unit 92 across to and over the corresponding driven sprocket wheel of unit 88 and thence downwardly terminating in end 80*b* which is rigidly secured by anchor 81*b* to corner frame member 38 at the same level as end 78*b* of chain 78. Chain 82 has first and second ends 82*a* and 82*b* respectively secured to corner members 34 and 40 of frame assembly 10 by anchors 83***a* and 83*b* and in the same disposition relative to the corner members and to the corresponding sprocket wheels as chain 80. Chain 84 has first and second ends 84*a* and 84*b* respectively secured to corner members 40 and 34 of frame 10 by anchors 85*a* and 85*b*, and chain 84 has the same disposition relative to the corner members and to the corresponding sprocket wheels as chain 78. It will be appreciated from FIG. 6 and the foregoing description that frame assembly 12 is supported in suspension at the four corners of stationary frame assembly 10 by the chain extending under the idler or driven sprocket wheel in the corresponding corner of the frame 12. It will likewise be appreciated that the drive chain arrangement maintains the individual chains taut so as to minimize any free play between the chains and corresponding sprocket wheels, thus to optimize stability and operation of the chains in unison to achieve elevating and lowering of frame assembly 12 relative to stationary frame 10. In operation, motor 98 rotates shaft 86 in one direction or the other to rotate the sprocket wheels of driven sprocket wheel units 88 and 90 in the same direction, and in response to rotation of shaft 86 in one direction, idler sprocket wheel units 92 and 94 are simultaneously rotated in the opposite direction, whereby frame assembly 12 literally climbs up or down the four chains depending on the direction of rotation of shaft 86.

In accordance with yet another aspect of the invention, ring member 14 is supported in suspension beneath reciprocable frame assembly 12 for vertical displacement therewith and for rotation relative thereto about axis 16. More particularly in this respect, with reference to FIGS. 1–5 of the drawing, ring member 14 is an outwardly open channel having a vertical web 104 and radially outwardly extending upper and lower peripheral flanges 106 and 108, respectively. Ring member 14 is suspended beneath reciprocable frame assembly 12 by a plurality of wheel assemblies 110 each of which, as will be appreciated from FIGS. 4 and 5, includes a wheel 112 underlying upper flange 106 and rotatable about a radially outwardly extending horizontal axis provided by a wheel axle 114. Wheels 112 are preferably of polymeric material, such as nylon, and axle 114 is suitably secured to a wheel mounting bracket comprising a mounting plate 116 and gusset plate 118 welded to the underside of one or the other of the plate portions 47 and 49 of frame members 46 and 48 of frame assembly 12.

Figure 4:
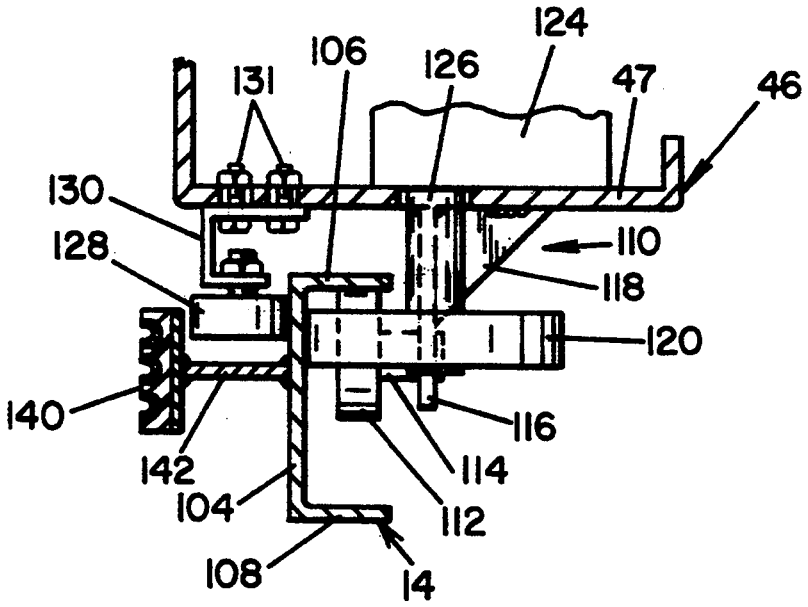
FIG. 4 is a cross-sectional elevation view of the ring support and drive components of the apparatus taken along line 4—4 in FIG. 3.

As will be appreciated from FIGS. 3 and 4, ring member 14 is adapted to be rotated about axis 16 by a friction drive wheel 120 which engages against the outer side of web 104 of ring member 14. At least the outer surface of drive wheel 120 is of rubber or the like to provide the necessary frictional drive, and wheel 120 is adapted to be rotated in opposite directions by an electric motor 122 and gear reducer 124 mounted on plate portion 47 of frame member 46 of frame assembly 12. Gear reducer 124 has an output shaft 126 extending through an opening therefor in plate portion 47, and drive wheel 120 is suitably secured to the output shaft for rotation therewith. Web 104 of ring member 14 is radially captured between drive wheel 120 and a guide wheel 128 mounted on plate portion 47 of frame member 46 by a radially adjustable bracket 130 and bolts 131. Guide wheel 128 is preferably of nylon and is rotatable about a vertical axis. parallel to the axis of drive wheel 120. Radial adjustment of guide wheel 128 provides for obtaining a desired frictional interengagement between drive wheel 120 and web 104 to assure rotation of ring member 14 without slippage between the web and drive wheel. While bracket 130 is shown as being adjustably mounted on plate portion 47 of frame member 46 for this purpose, the desired adjustment capability for the guide wheel could be provided by mounting the wheel on bracket 130 for radial adjustment relative thereto, or by providing an eccentric mounting for the wheel shaft on the bracket.

Figure 5:
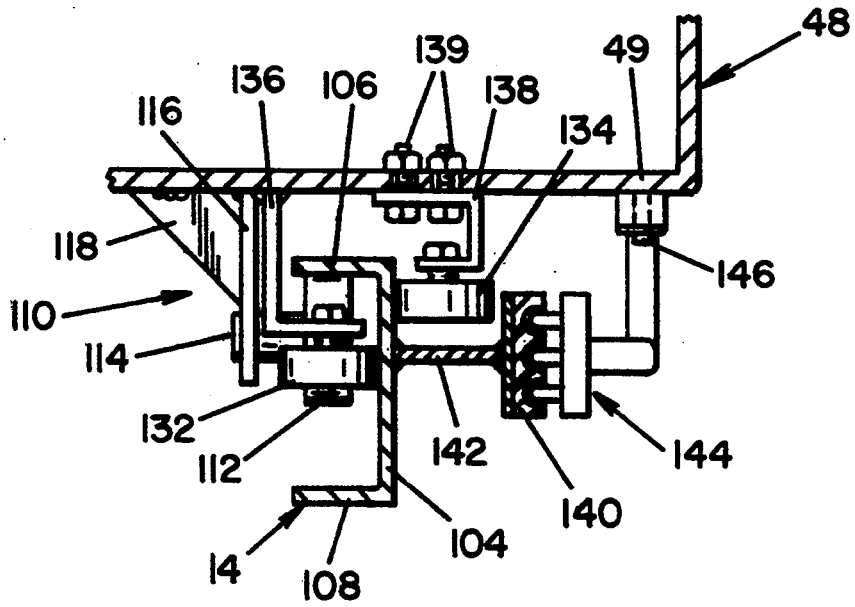
FIG. 5 is a sectional elevation view of the ring supporting and guiding components taken along line 5—5 in FIG. 3.

As will be appreciated from FIGS. 3 and 5, web 104 of ring member 14 is radially captured between a pair of guide wheels 132 and 134 mounted on plate portion 49 of frame member 48 of frame assembly 12 by mounting brackets 136 and 138, respectively. Each of the wheels 132 and 134 is preferably of nylon and is rotatable about a corresponding vertical axis, and at least one of the mounting brackets 136 and 138 is radially adjustable to facilitate obtaining a desired interengaging relationship between the guide wheels and web 104. For this purpose, mounting bracket 138 is shown in FIG. 5 as being radially adjustably moved on plate portion 49 by means of bolts 139 but, as described above in connection with bracket 130 for guide wheel 128, radial adjustment can be achieved otherwise. To facilitate the conducting of electricity to film carriage assembly 28 mounted on ring 14, an annular slip ring assembly 140 is mounted on the inner side of web 104 of ring member 14 by a slip ring support plate 142, and plate portion 49 of frame member 48 is provided with a brush assembly 144 interengaging with the slip ring assembly and pivotally mounted on plate portion 49 by means of a pivot pin 146.

As will be appreciated from FIGS. 3–5 and the foregoing description, web 104 of ring member 14 is radially engaged between pairs of wheels angularly spaced apart about 90° relative to axis 16. These pairs of wheels, in being mounted on reciprocable frame assembly 12 and radially fixed relative to web 104, cooperatively provide fixed guidance for rotation of ring member 14 between the locations thereof. By providing such fixed guidance at just two angularly spaced locations, ring member 14, even if out-of-round, can be rotated relative to frame assembly 12 without any undesirable interference between the ring support, guidance and drive components. Partly in this respect, it will be noted that support wheels 112 underlie upper flange 106 of ring member 14 radially between the inner and outer ends of the upper flange, whereby there can be horizontal displacement of ring member 14 relative to frame assembly 12, thus to accommodate rotation of a ring member which is not perfectly round. Further in this respect, while four support wheel assemblies 110 are shown in FIG. 3 as being provided in diametrically opposed pairs, it will be appreciated that additional support wheel assemblies can be provided between frame assembly 12 and ring member 14 to assure that the ring member is appropriately supported for rotation even if such horizontal displacement should be sufficient to move the ring member out of engagement with one of the support wheels.

While considerable emphasis has been placed on the preferred embodiments of the invention herein illustrated and described, it will be appreciated that many changes can be made in the disclosed embodiments and that other embodiments can be made without departing from the principles of the present invention. Accordingly, it is to be distinctly understood that the foregoing descriptive matter is to be interpreted merely as illustrative of the invention and not as a limitation.

Having thus described the invention, it is claimed:

1. In apparatus for wrapping articles in film material and comprising first frame means for receiving an article to be wrapped, second frame means reciprocable vertically relative to said first frame means, means to reciprocate said second frame means, a ring member, means supporting said ring member on said second frame means for vertical displacement therewith and for rotation relative thereto about a vertical ring axis, means to rotate said ring member, and means including film carriage means on said ring member for wrapping film material about said article during rotation of said ring member, the improvement comprising: said ring member including a generally vertically extending web having an inner side and an outer side and a generally horizontally extending peripheral flange, and said means supporting said ring member on said second frame means including a plurality of wheels on said second frame means angularly spaced apart about said ring axis and each rotatable about a corresponding horizontal wheel axis, said peripheral flange resting on said plurality of wheels, and a pair of wheels on said second frame means each rotatable about a corresponding vertical wheel axis, means for mounting said pair of wheels for frictional engagement with said inner side and said outer side of said web radially therebetween.

2. The improvement according to claim 1, wherein one of said pair of wheels is a drive wheel and said means to rotate said ring member includes means on said second frame means to rotate said drive wheel.

3. The improvement according to claim 2, further comprising means for radially adjusting the other of said pair of wheels relative to said ring axis.

4. The improvement according to claim 3, wherein said pair of wheels is a first pair, and further comprising a second pair of wheels on said second frame means angularly spaced from said first pair of wheels relative to said ring axis, each wheel of said second pair being rotatable about a corresponding vertical wheel axis, and said second pair of wheels engaging said web radially therebetween.

5. The improvement according to claim 4, further comprising means for radially adjusting at least one of said second pair of wheels relative to said ring axis.

6. The improvement according to claim 2, wherein said pair of wheels is a first pair, and further comprising a second pair of wheels on said second frame means angularly spaced from said first pair of wheels relative to said ring axis, each wheel of said second pair being rotatable about a corresponding vertical wheel axis, and said second pair of wheels engaging said web radially therebetween.

7. The improvement according to claim 1, further comprising first and second pairs of interengaging guide components between said first and second frame means, the guide components of each pair of guide components interengaging to guide vertical displacement of said second frame means relative to said first frame means, and said first and second pairs of guide components being generally diametrically opposed relative to said ring axis.

8. The improvement according to claim 7, wherein each said first and second pair of guide components includes a guide channel on one of said first and second frame means and a guide block on the other of said first and second frame means and slidably received in said guide channel.

9. The improvement according to claim 8, wherein said guide channel is on said first frame means and said guide block is on said second frame means.

10. The improvement according to claim 9, wherein said guide block is of polymeric material.

11. The improvement according to claim 7, wherein said first and second pairs of guide components alone guide vertical reciprocation of said second frame means relative to said first frame means.

12. The improvement according to claim 11, wherein each said first and second pairs of guide components include a guide channel on said first frame means and a guide block of polymeric material on said second frame means and slidably received in said guide channel.

13. In apparatus for wrapping articles in film material and comprising first frame means for receiving an article to be wrapped, second frame means reciprocable vertically relative to said first frame means, means to reciprocate said second frame means, a ring member, means supporting said ring member on said second frame means for vertical displacement therewith and for rotation relative thereto about a vertical ring axis, means to rotate said ring member, and means including film carriage means on said ring member for wrapping film material about said article during rotation of said ring member, the improvement comprising: said ring member including a generally vertically extending web having an inner side and an outer side and a generally horizontally extending peripheral flange, and said means supporting said ring member on said second frame means including a plurality of wheels on said second frame means angularly spaced apart about said ring axis and each rotatable about a corresponding horizontal wheel axis, said peripheral flange resting on said plurality of wheels, and a pair of wheels on said second frame means each rotatable about a corresponding vertical wheel axis, said pair of wheels engaging said inner side and said outer side of said web radially therebetween, said means to reciprocate said second frame means includes flexible chain means having horizontally and vertically spaced apart opposite ends rigidly secured to said first frame means, rotatable drive means on said second frame means, said chain means interengaging with said drive means between said opposite ends of said chain means, and means on said second frame means to rotate said drive means.

14. The improvement according to claim 13, wherein said chain means is link chain means and said drive means includes sprocket means.

15. The improvement according to claim 13, wherein said chain means includes at least two chain members each having horizontally and vertically spaced apart opposite ends, said drive means being horizontally spaced apart, said two chain members interengaging with said drive means such that the portions of the chain members between said drive means extend along paths which cross one another intermediate said drive means.

16. The improvement according to claim 15, wherein said two chain members are link chains, said drive means includes sprocket wheels, and said means to rotate said drive means includes motor means to rotate at least one sprocket wheel of each link chain.

17. The improvement according to claim 13, wherein said chain means includes first and second pairs of link chains, the chains of each pair having horizontally and vertically spaced apart opposite ends, said drive means including horizontally spaced apart sprocket wheels for the chains of each pair, the chains of each pair extending between the sprocket wheels therefor along paths which cross one another intermediate said sprocket wheels, and said means to rotate said drive means including means to simultaneously rotate at least one sprocket wheel for each chain.

18. The improvement according to claim 17, wherein said at least one sprocket wheel for each chain is mounted on a common shaft and said means to rotate said drive means further includes motor means to rotate said shaft.

19. The improvement according to claim 13, further comprising first and second pairs of interengaging guide components between said first and second frame means, the guide components of each pair of guide components interengaging to guide vertical displacement of said second frame means relative to said first frame means, and said first and second pairs of guide components being generally diametrically opposed relative to said ring axis.

20. The improvement according to claim 19, wherein said pair of wheels is a first pair, one of said first pair of wheels being a drive wheel, said means to rotate said ring means including means on said second frame means to rotate said drive wheel, and a second pair of wheels on said second frame means angularly spaced from said first pair of wheels relative to said ring axis, each wheel of said second pair being rotatable about a corresponding vertical wheel axis, and said second pair of wheels engaging said web radially therebetween.

21. The improvement according to claim 20, wherein the other of said first pair of wheels is radially adjustable relative to said ring axis and at least one of said second pair of wheels is radially adjustable relative to said ring axis.

22. The improvement according to claim 19, wherein each said first and second pairs of guide components include a guide channel on said first frame means and a guide block of polymeric material on said second frame means and slidably received in said guide channel.

23. The improvement according to claim 22, wherein said first and second pairs of guide components alone guide vertical reciprocation of said second frame means relative to said first frame means.

24. The improvement according to claim 19, wherein said chain means includes first and second pairs of link chains, the chains of each pair having horizontally and vertically spaced apart opposite ends, said drive means including horizontally spaced apart sprocket wheels for the chains of each pair, the chains of each pair extending between the sprocket wheels therefor along paths which cross one another intermediate said sprocket wheels, and said means to rotate said drive means including means to simultaneously rotate at least one sprocket wheel for each chain.

25. The improvement according to claim 24, wherein said at least one sprocket wheel for each chain is mounted on a common shaft and said means to rotate said drive means further includes motor means to rotate said shaft.

26. The improvement according to claim 25, wherein said pair of wheels is a first pair, one of said first pair of wheels being a drive wheel, said means to rotate said ring means including means on said second frame means to rotate said drive wheel, and a second pair of wheels on said second frame means angularly spaced from said first pair of wheels relative to said ring axis, each wheel of said second pair being rotatable about a corresponding vertical wheel axis, and said second pair of wheels engaging said web radially therebetween.

27. The improvement according to claim 26, wherein the other of said first pair of wheels is radially adjustable relative to said ring axis and at least one of said second pair of wheels is radially adjustable relative to said ring axis.

28. The improvement according to claim 26, wherein each said first and second pairs of guide components include a guide channel on said first frame means and a guide block of polymeric material on said second frame means and slidably received in said guide channel.

29. The improvement according to claim 28, wherein said first and second pairs of guide components alone guide vertical reciprocation of said second frame means relative to said first frame means.

30. In apparatus for wrapping articles in film material and comprising first frame means for receiving an article to be wrapped, second frame means reciprocable vertically relative to said first frame means, means to reciprocate said second frame means, a ring member, means supporting said ring member on said second frame means for vertical displacement therewith and for rotation relative thereto about a vertical ring axis, means to rotate said ring member, and means including film carriage means on said ring member for wrapping film material about said article during rotation of said ring member, the improvement comprising: said means to reciprocate said second frame means including flexible chain means having horizontally and vertically spaced apart opposite ends rigidly secured to said first frame means, rotatable drive means on said second frame means, said chain means interengaging with said drive means between said opposite ends of said chain means, and means on said second frame means to rotate said drive means.

31. The improvement according to claim 30, wherein said chain means is link chain means and said drive means includes sprocket means.

32. The improvement according to claim 30, wherein said chain means includes at least two chain members each having horizontally and vertically spaced apart opposite ends, said drive means being horizontally spaced apart, said two chain members interengaging with said drive means such that the portions of the chain members between said drive means extend along paths which cross one another intermediate said drive means.

33. The improvement according to claim 32, wherein said two chain members are link chains, said drive means includes sprocket wheels, and said means to rotate said drive means includes motor means to rotate at least one sprocket wheel of each link chain.

34. The improvement according to claim 30, wherein said chain means includes first and second pairs of link chains, the chains of each pair having horizontally and vertically spaced apart opposite ends, said drive means including horizontally spaced apart sprocket wheels for the chains of each pair, the chains of each pair extending between the sprocket wheels therefor along paths which cross one another intermediate said sprocket wheels, and said means to rotate said drive means including means to simultaneously rotate at least one sprocket wheel for each chain.

35. The improvement according to claim 34, wherein said at least one sprocket wheel for each chain is mounted on a common shaft and said means to rotate said drive means further includes motor means to rotate said shaft.

* * * * *